United States Patent [19]

Chihana

[11] Patent Number: 4,539,883

[45] Date of Patent: Sep. 10, 1985

[54] ELECTRONIC MUSICAL INSTRUMENT PERFORMING D/A CONVERSION OF PLURAL TONE SIGNALS

[75] Inventor: Masanobu Chihana, Hamamatsu, Japan

[73] Assignee: Nippon Gakki Seizo Kabushiki Kaisha, Hamamatsu, Japan

[21] Appl. No.: 553,745

[22] Filed: Nov. 21, 1983

[30] Foreign Application Priority Data

Nov. 25, 1982 [JP] Japan ..... 57-205503

[51] Int. Cl.[3] ..... G10H 1/08; G10H 7/00

[52] U.S. Cl. ..... 84/1.22; 84/1.01; 84/1.24

[58] Field of Search ..... 84/1.01, 1.11, 1.12, 84/1.19–1.24

[56] References Cited

U.S. PATENT DOCUMENTS

| | | | |
|---|---|---|---|
| 4,144,789 | 3/1979 | Deutsch | 84/1.01 X |
| 4,269,101 | 5/1981 | Deutsch et al. | 84/1.01 |
| 4,287,802 | 9/1981 | Imamura et al. | 84/1.01 |

*Primary Examiner*—S. J. Witkowski

*Attorney, Agent, or Firm*—Spensley, Horn, Jubas & Lubitz

[57] ABSTRACT

This electronic musical instrument comprises digital tone generation circuits having a plurality of tone generation channels each being capable of selecting a tone color independently from other channels. In each of the tone generation circuits, digital tone signals having the selected tone colors are produced in response to operation of a key or a switch. A specific number of analog channels are provided for processing analog tone signals channel by channel and a channel divider is also provided for distributing the digital tone signals generated by the digital tone generation circuits to these analog channels in specific combinations according to the selected tone colors. This channel divider further mixes the distributed digital tone signals together for each of the analog channels for time-division-multiplexing the mixed digital tone signals for each of the analog channels. The multiplexed digital tone signals are converted to analog signals by means of a single digital-to-analog converter. The converted analog signals are sampled and held for each of the analog channels and are made parallel.

9 Claims, 8 Drawing Figures

ELECTRONIC MUSICAL INSTRUMENT PERFORMING D/A CONVERSION OF PLURAL TONE SIGNALS

BACKGROUND OF THE INVENTION

This invention relates to an electronic musical instrument capable of sounding a tone signal generated in digital after converting it to an analog signal and, more particularly, to an instrument capable of converting digital tone signals of different tone groups individually to analog signals.

Tone signals generated by an electronic musical instrument can be classified into groups on the basis of some common standard such, for example, as the keyboard type, tone color and tone effect. Such groups of tones are herein called tone groups. In an electronic musical instrument, tone generation routes are generally provided individually for different types of tone groups. In an electronic musical instrument of a digital tone generation system, therefore, a digital tone generation circuit (or channel) is provided for each of a plurality of tone groups classified according to a classification item which is suitably chosen from the standpoint of design of the instrument, a digital tone signal being generated with respect to each of these tone groups. For example, in a prior art electronic musical instrument, these tone groups are suitably called such as "orchestra tones", "special tones", "preset tones" and "custom tones" according to difference in the tone forming system and switches for selecting a tone color, tone level and tone effect are provided for each of these tone groups. Since a digital tone signal must be generated individually for each of these tone groups, a problem arises as to how a digital-to-analog conversion circuit should be provided. For converting a digital tone signal to an analog signal while maintaining sufficient resolution and dynamic range, an expensive multi-bit type digital-to-analog converter is required. It is undesirable in view of the cost and scale of circuit to employ many of such digital-to-analog converter. Nevertheless, digital-to-analog conversion in the electronic musical instrument comprising a plurality of tone groups has been performed individually for each of the tone groups and an analog tone signal has had to be produced separately for each necessary tone group. One requirement therefor is to increase a tonal effect by distributing analog tone signals for respective tone groups among various speakers such as left, right and center ones. Another requirement is to enable a different tone level adjustment separately for each of the tone groups. Still another requirement is to impart a modulation effect to a specific tone group in a state of an analog tone state. For these reasons, a plurality of digital-to-analog converters had to be used, one being provided for each of these tone groups, in spite of the cost and the large scale circuit design it involves.

It is an object of the present invention to provide an electronic musical instrument capable of effecting the digital-to-analog conversion efficiently and at a low cost by employing only a small number of digital-to-analog converters.

SUMMARY OF THE INVENTION

According to the invention, the electronic musical instrument comprises distribution means for distributing digital tone signals corresponding to respective tone groups to a specific number of channels in accordance with certain combinations, mixing means for mixing the distributed tone signals with respect to each of the channels and multiplexing means for time-division-multiplexing, with respect to each of the channels, digital tone signals of the respective channels provided by the mixing means, and converts digital tone signals provided by the multiplexing means to an analog tone signal by applying the digital signal to a digital-to-analog converter. Accordingly, only one or a small number of digital-to-analog converter are required so that the digital-to-analog conversion of tone signals for each tone group can be performed at a low cost. Further, since digital tone signals of a plurality of tone groups are distributed in the specific combinations to the specific number of channels (channels corresponding to analog tone groups) and mixed together by the distribution and mixing means and thereafter are subjected to the digital-to-analog conversion, time slots for the digital-to-analog conversion may be provided in the number corresponding to the minimum number of analog tone groups which are much fewer than digital tone groups, so that an efficient digital-to-analog conversion is realized. The minimization of the number of time division channels for the digital-to-analog conversion allows time division channels to have sample time width and affords sufficient time to one cycle of the time division conversion process thereby realizing an efficient digital-to-analog conversion without requiring a high-speed performance in the digital-to-analog converter or without reducing high-fidelity owing to setting of a proper sampling cycle.

Further, according to the present invention, data conversion means for converting real number data of a digital tone signal to data in a floating-point representation consisting of mantissa data and exponent data is provided between the multiplexing means and the digital-to-analog converter so as to digital-to-analog convert the mantissa data which is of a smaller bit number than the real number data. An output analog signal of the digital-to-analog converter is divided in voltage in response to the exponent data with a result that an analog tone signal corresponding to an original digital tone signal (real number data) to be converted is derived. Consequently, the digital-to-analog converter can be made more compact and can be manufactured at a lower cost.

BRIEF DESCRIPTION OF THE DRAWINGS

In the accompanying drawings.

DESCRIPTION OF A PREFERRED EMBODIMENT

Figure 1:
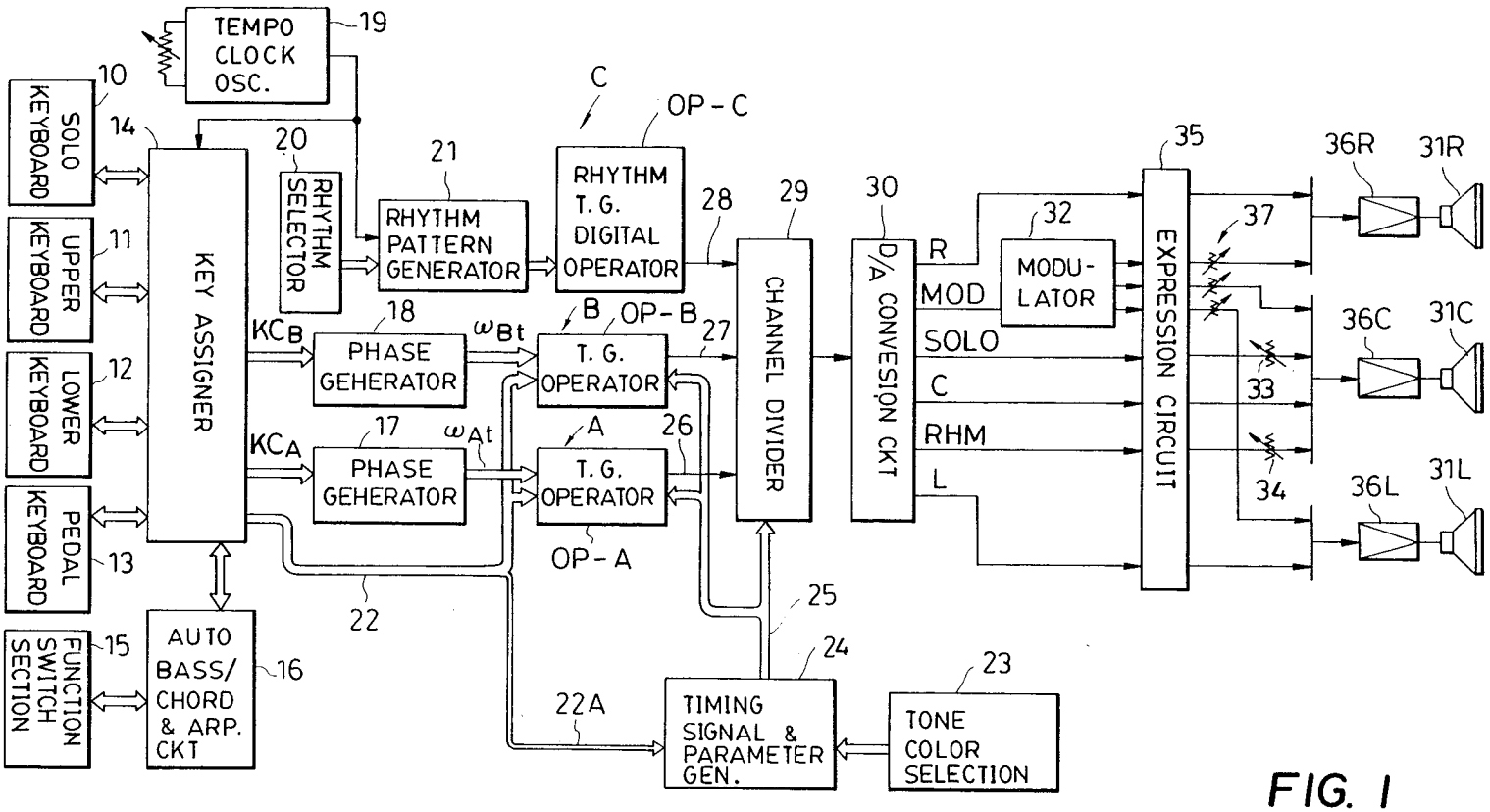
FIG. 1 is a block diagram showing an embodiment of the electronic musical instrument according to the invention.

Referring to FIG. 1, an electronic musical instrument comprises a solo keyboard 10, an upper keyboard 11, a lower keyboard 12 and a pedal keyboard 13. A key assigner 14 detects depression and release of keys in the keyboards 10–13 and assigns a depressed key to an available one of a plurality of tone generation channels. A function switch section 15 includes a mode selection switch for an automatic bass/chord performance and an automatic arpeggio performance. An automatic bass/-chord and arpeggio circuit 16 is operated in accordance with a mode having been selected by the function switch section 15 to prepare a key code corresponding to an automatic bass tone, chord tone or arpeggio tone by utilizing information of the depressed key or keys provided by the key assigner 14 and supply this key codes to the key assigner 14. The key assigner 14 assigns the key codes corresponding to the automatic tones to a predetermined tone generation channel.

Three tone generation routes A, B and C are provided, each route corresponding to one or more predetermined tone groups. A phase generator 17 and a tone generation operator OP-A are provided for the first tone generation route A. This route is used for four tone groups which are named, for the sake of convenience, upper keyboard orchestra tones, lower keyboard orchestra tones, upper keyboard special tones and lower keyboard special tones. A phase generator 18 and a tone generation operator OP-B are provided for the second tone generation route B. This route is used for five tone groups which are named solo keyboard tones, upper keyboard custom tones, pedal keyboard custom tones, bass tones and arpeggio tones. A tempo clock oscillator 19 capable of producing a variable tempo clock, a rhythm selector 20, a rhythm pattern generator 21 and a rhythm tone generation digital operator OP-C are provided for the third tone generation route C. This route is used for two tone groups which are named rhythm I tones and rhythm II tones which are both automatic rhythm tones.

Features of the respective tone groups will now be briefly described. The orchestra tones correspond to tone colors of continuous tones, e.g., a tone color of a wind instrument such as a flute, and are capable of being sounded as polyphonic tones. Tones for keys depressed in the upper keyboard 11 and the lower keyboard 12 are generated in this tone group and are classified into the upper keyboard orchestra tones or the lower keyboard orchestra tones depending upon the type of the keyboard. The special tones correspond to tone colors of release tones, e.g., a piano tone and are capable of being sounded as polyphonic tones. Tones for keys depressed in the upper keyboard 11 and the lower keyboard 12 are generated in this tone group and are classified into the upper keyboard special tones or the lower keyboard special tones depending upon the type of the keyboard. The upper keyboard custom tones correspond to tones for keys depressed in the upper keyboard 11 and a tone of this tone group is always generated singly (e.g., only the highest tone). The pedal keyboard custom tones correspond to tones for keys depressed in the pedal keyboard 13 and a tone of this tone group is always generated singly. The solo tones correspond to tones for keys depressed in the solo keyboard 10. The bass tones correspond to bass tones (automatic bass tones and pedal keyboard tones). The arpeggio tones correspond to automatic arpeggio tones. The rhythm I tones correspond to rhythm tones of drums (vibrating tones) and the rhythm II tones correspond to rhythm tones of cymbals (noises).

In the first and second tone generation routes A and B, tones corresponding to depressed keys are generated in accordance with the assignment performed by the key assigner 14. The key assigner 14 separately produces a key code $KC_A$ representing a key assigned to the first tone generation route A and a key code $KC_B$ representing a key or an automatic tone assigned to the second tone generation route B. For enabling generation of the orchestra tones and special tones, depressed keys in the upper keyboard 11 and the lower keyboard 12 (including the automatic chord tones) are assigned to the first tone generation route A in the key assigner 14 and thereupon the key code $KC_A$ representing the assigned key is produced. To the second tone generation route B is assigned, for enabling generation of tones of the above described five tone groups corresponding to this route, depressed keys in the solo keyboard 10, a single depressed key in the upper keyboard 11, a single depressed key in the pedal keyboard 13, bass tones and arpeggio tones in the key assigner 14 and thereupon the key code $KC_B$ representing the assigned key or tone is produced.

The respective tone generation routes A and B comprise plurality of tone generation channels and these channels generate tones on a time shared basis by utilizing on a time shared basis the single tone generation operator OP-A in the route A and the single tone generation operator OP-B in the route B. The key assigner 14 produces, in time division, the key codes $KC_A$ and $KC_B$ assigned to the respective tone generation channels in the routes A and B at time division time slots of the respective channels.

Figure 2:
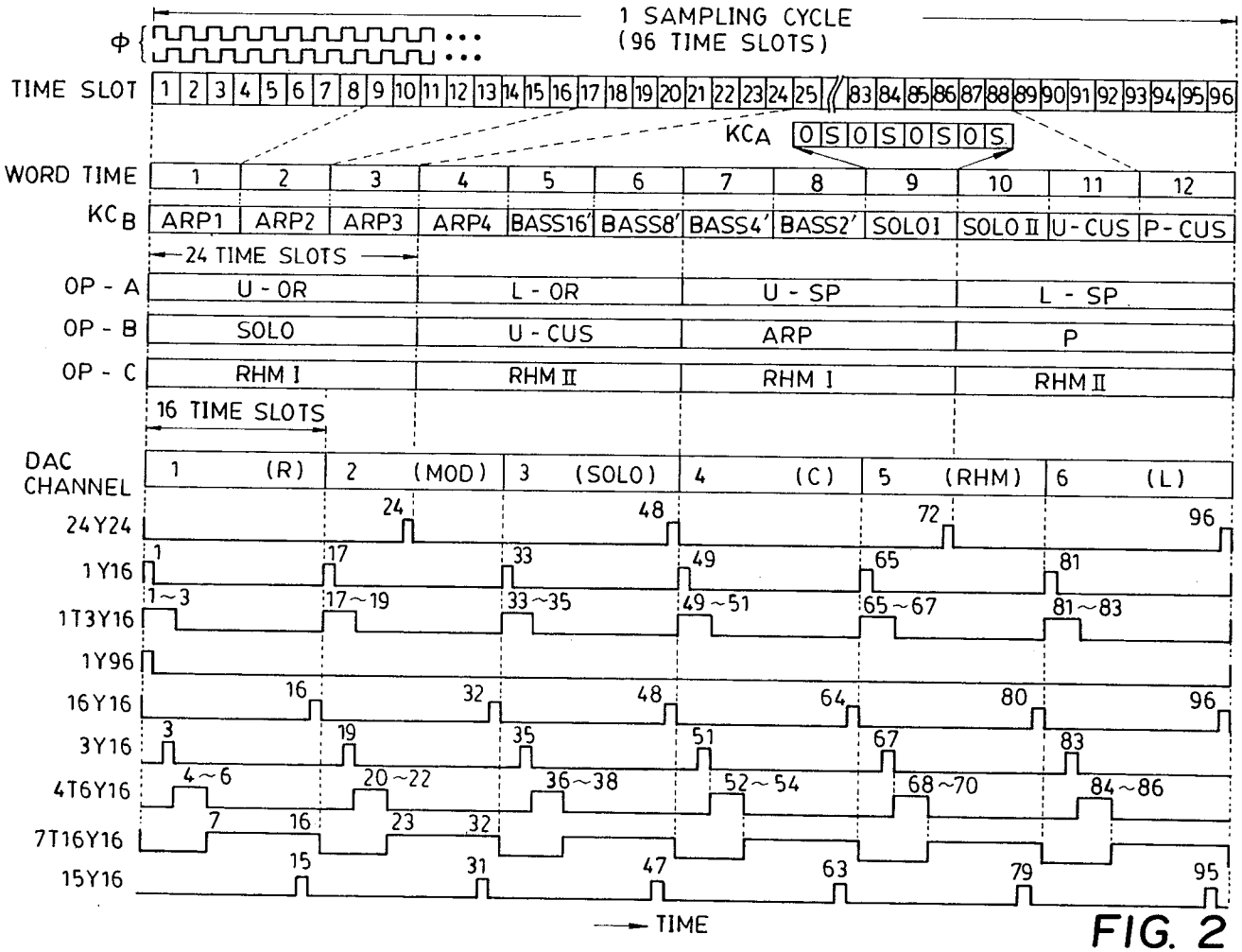
FIG. 2 is a time chart showing timings of various signals and operations in the embodiment of FIG. 1.

FIG. 2 shows an example of the time relationship of the time division process for the tone signal generation. The unit time slot is formed in synchronism with a 2-phase clock pulse $\phi$. The clock pulse $\phi$ may have a frequency of, for example, 4.8 MHz and one time slot may have a width of 208 ns. One cycle of the time division process consists of 96 time slots. Dividing this one cycle into 12 equal time lengths, each of the obtained twelve 8-time-slot lengths will be herein called a word time. In FIG. 2, the clock pulse $\phi$ and the time slot are shown on a larger time scale than the word time.

One word time corresponds to the assignment time for one channel in the key assigner 14. The key assigner 14 assigns various keys or tones to the individual word times in the tone generation routes A and B respectively and produces the key codes $KC_A$, $KC_B$, which indicate the assigned keys or tones, in the respective word times in time division. In the first route A, the depressed keys of the upper keyboard 11 and the lower keyboard 12 are assigned to given channels (word times). In the second route B, the depressed keys or tones corresponding to the respective tone groups are assigned to predetermined channels (word times) on a tone group-wise basis. As shown in the row $KC_B$ in FIG. 2, for instance, at most 4 automatic arpeggio tones (designated by ARP1 to ARP4) are assigned to the 4 channels corresponding to the 1st to 4th word time, 16-foot to 2-foot bass tones (BASS 16' to BASS 2') are assigned to the 4 channels corresponding to the 5th to 8th word time, depressed keys in the solo keyboard 10 are assigned both to the channels corresponding to the 9th and 10th word times (designated by SOLO I, SOLO II) to form tones which are different from each other, a single depressed key for the upper keyboard custom tones (U-CUS) is assigned to the channel corresponding to the 11th word time, and a single depressed key for the pedal keyboard custom tones (P-CUS) is assigned to the 12th word time.

In the route B, a tone signal for only one tone is generated in each word time (channel) based on the key code $KC_B$ assigned to each word time (channel) (therefore in the route B, tone signals for at most 12 tones are generated) whereas in the route A, tone signals for 2 tones are generated in each word time (channel) based on the key code $KC_A$. That is, tone signals for the orchestra tones and special tones are generated in response to unit key code $KC_A$. For that purpose, in the route A the 8 time slots in one-word time are alternately used for the orchestra tones O and special tones S, namely, 4 time slots are used to form each of these 2 tones in response to the unit key code $KC_A$. FIG. 2 shows the 8 time slots of the 9th word time on an enlarged scale.

In response to the key codes $KC_A$, $KC_B$, the phase generators 17, 18 produce instantaneous phase angle information $\omega_A t$, $\omega_B t$ in digital which repeatedly change at the frequencies corresponding to the pitches of the keys or tones expressed by these key codes. The time division timings of the instantaneous phase angle information $\omega_A t$, $\omega_B t$ are identical to those of the key codes $KC_A$, $KC_B$. Therefore, the instantaneous phase angle information $\omega_A t$, $\omega_B t$ corresponding to various keys or tones are produced in time division on a word time-wise basis.

The tone generation operators OP-A, OP-B generate digital tone signals based on the digital instantaneous phase angle information $\omega_A t$, $\omega_B t$. The tone generation method employed may be a tone synthesis method based on the frequency modulation operation or a tone generation method based on the digital combined waveform memory or any other appropriate tone generation method. In addition to the phase angle information $\omega_A t$, $\omega_B t$, information necessary for tone generation is supplied from the key assigner 14 to the operators OP-A, OP-B through a line 22. The information supplied to the line 22 includes, for example, a key-on signal used for envelope control of tone signals, a signal indicating whether the key code $KC_A$ assigned to each channel (word time) belongs to the upper keyboard or lower keyboard, and the like. The tone color parameter corresponding to the tone color selected by a tone color selection device 23 and various timing signals are generated by a timing signal and parameter generator 24 and supplied to the operators OP-A, OP-B through a line 25. The tone color selection device 23 is capable of selecting tone colors and effects on a tone group-wise basis. Using the parameter signals and timing signals through the line 25, the operators OP-A, OP-B generate tone signals, providing them with the tone colors selected on a tone group-wise basis. The signal indicating whether the key assigned to each channel of the route A belongs to the upper keyboard or the lower keyboard is also supplied to the generator 24 from the line 22 through a line 22A.

In the route C, a rhythm pattern generator 21 generates pattern pulses, which indicate the sounding timings of the rhythm tones according to the kinds of rhythms selected by the rhythm selector 20, based on the output of a tempo clock oscillator 19. The rhythm tone generation digital operator OP-C generates rhythm tone signals in digital according to the rhythm pattern pulses generated from the rhythm pattern generator 21 and comprises a digital combined waveform memory, digital noise generator, and other operators. The output of the tempo clock oscillator 19 is also supplied to an automatic bass chord and arpeggio circuit 16 and used to set the sounding timing of the automatic tones.

The operators OP-A to OP-C add tone signals, which were generated in the respective word times, on a tone group-wise basis and time division multiplexes and timewise serially delivers the added tone group-wise digital tone signals. One digital tone signal corresponding to one tone group consists of 24-bits and is timewise serialized using 24 time slots. The operator OP-A for the route A produces tone signals for the 4 tone groups: the upper keyboard orchestra tones U-OR, lower keyboard orchestra tones L-OR, upper keyboard special tones U-SP and the lower keyboard special tones L-SP. As mentioned above, the operator OP-A adds plural tone signals, which were generated at the respective word times, on a tone group-wise basis and delivers the resulting 4 kinds of tone signals in time division at timings corresponding to the respective tone groups U-OR to L-SP. The operator OP-B for the route B produces tone signals for the 4 tone groups: the solo keyboard tones SOLO, upper keyboard custom tones U-CUS, arpeggio tones ARP, and pedal keyboard tones P. More specifically, the solo keyboard depressed key tones (SOLO I, SOLO II) of different tone characteristics generated at the 9th and 10th word time, respectively are added and delivered as a tone signal of the solo keyboard tones SOLO. The tone signal of the upper keyboard custom tones U-CUS generated at the 11th word time is produced as it is, i.e., as the tone signal of the upper keyboard custom tones U-CUS. The automatic arpeggio tone signals ARP1 to ARP4 generated at the 1st to 4th word times are added and delivered as a tone signal of the arpeggio tones ARP. The bass tone signals BASS 16' to BASS 2' generated at the 5th to 8th word times and the pedal keyboard custom tone signal P-CUS generated at the 12th word time are added and produced as a tone signal of the pedal keyboard tones P.

As shown in the row OP-C in FIG. 2, the operator OP-C repeatedly produces the digital tone signals of the 2 tone groups RHMI, RHMII at a ½ cycle by time division multiplexing. A 24-bit tone signal of each tone group is timewise serialized as in the case of the operators OP-A and OP-B. At the output timings of RHM I, a digital tone signal obtained by adding rhythm tone signals of rhythm I tones or drums tones is delivered whereas at the output timings of RHM II, a digital tone signal obtained by adding rhythm tone signals of the rhythm II tones or noise tones is delivered.

The digital tone signals produced by the operators OP-A to OP-C are supplied through respective lines 26, 27, 28 to a channel divider 29. The channel divider 29 is provided to add and mix and distribute the tone signals from the lines 26, 27, 28 to predetermined time division channels so as to use a digital-to-analog conversion circuit 30 at a post-stage in time division among a predetermined number of channels. The number of the time division channels is determined according to the number of the tone groups requiring different analog signal processes. Six channels, for instance, are necessary in case there are a tone group to be sounded through a right speaker 31R, a tone group to be sounded through a central speaker 31C, a tone group to be sounded through a left speaker 31L, a tone group to be passed to a modulator 32, the tone group solo keyboard tones SOLO of which the tone volume needs to be regulated individually by a tone volume regulator 33, and the tone group of the rhythm tones RHM of which the tone volume needs to be regulated individually by a tone volume regulator 34.

The time division timings of the respective channels in the digital-to-analog conversion circuit 30 is as shown in the DAC channel in FIG. 2. As will be seen, one cycle (96 time slots) is divided into 6 equal lengths, each consisting of 16 time slots. To the 1st channel is assigned the right speaker tone group R, to the 2nd channel the tone group MOD related to the modulator, to the 3rd channel the solo keyboard tone group SOLO, to the 4th channel the central speaker tone group, to the 5th channel the rhythm tone group RHM, and to the 6th channel the left speaker tone group L. The channel divider 29 reclassifies the tone signals of the 10 different tone groups (U-OR, L-OR, U-SP, L-SP, SOLO, U-CUS, ARP, P, RHM I, RHM II), which were supplied to the lines 26, 27, 28, into the above 6 tone groups (R, MOD, SOLO, C, RHM, L) for delivery such that these tone groups are assigned to the 6 time division channels (see DAC channel in FIG. 2), respectively. The solo keyboard tone group SOLO to be assigned to the 3rd channel solely consists of the tone signals of the solo keyboard tone group SOLO supplied to the line 27. The rhythm tone group RHM to be assigned to the 5th channel consists of the sum of the tone signals belonging to the rhythm I and rhythm II tone groups RHM I, RHM II supplied to the line 28. One or more of the 10 tone groups supplied to the input lines 26 to 28 are accumulating distributed and assigned to the tone groups R, MOD, C, L which correspond to the 1st, 2nd, 4th, 6th channel in response to the tone colors selected at present in the tone color selection device 23 against the respective 10 different tone groups supplied to the input lines 26 to 28. For that purpose, the timing signals and parameter signals corresponding to the selected tone colors are supplied from the generator 24 to the channel divider 29 through the line 25.

The digital-to-analog conversion circuit 30 uses a single digital-to-analog converter in time division according to the distribution and assignment by the channel divider 29 to convert the digital tone signals of the tone groups R, MOD, SOLO, C, RHM, L into analog, holds the analog-converted tone signals on a tone group-wise basis and produces the analog tone signal of each tone group in parallel. The analog tone signal relating to the right speaker tone group R is supplied to an audio amplifier 36R for the right speaker 31R through an expression circuit 35. The analog signal of the modulator tone group MOD is added to the modulator 32 and provided with modulation effects. For instance, the modulator 32 divides the input signals into 3 groups and provides each with different phase modulation using a BBD (bucket brigade device) and the like to obtain ensemble effects. The respective output signals of the modulator 32 are supplied through the expression circuit 35 to the tone volume regulator 37 to have the tone volume regulated individually and distributed to the respective speakers 31R, 31C, 31L. The analog tone signals of the solo keyboard tones SOLO, the central speaker tones C and the rhythm tones RHM are added to an audio amplifier 36C for the central speaker 31C through the expression circuit 35. As mentioned before, the solo keyboard tones SOLO and rhythm tones RHM have their tone volumes regulated respectively by the tone volume regulators 33, 34. The analog tone signals of the left speaker tones L are added to an audio amplifier 36L for the left speaker 31L through the expression circuit 35. As is known, the expression circuit 35 controls the tone volume of tone signals in response to the operation of an expression pedal (not shown).

Figure 3:
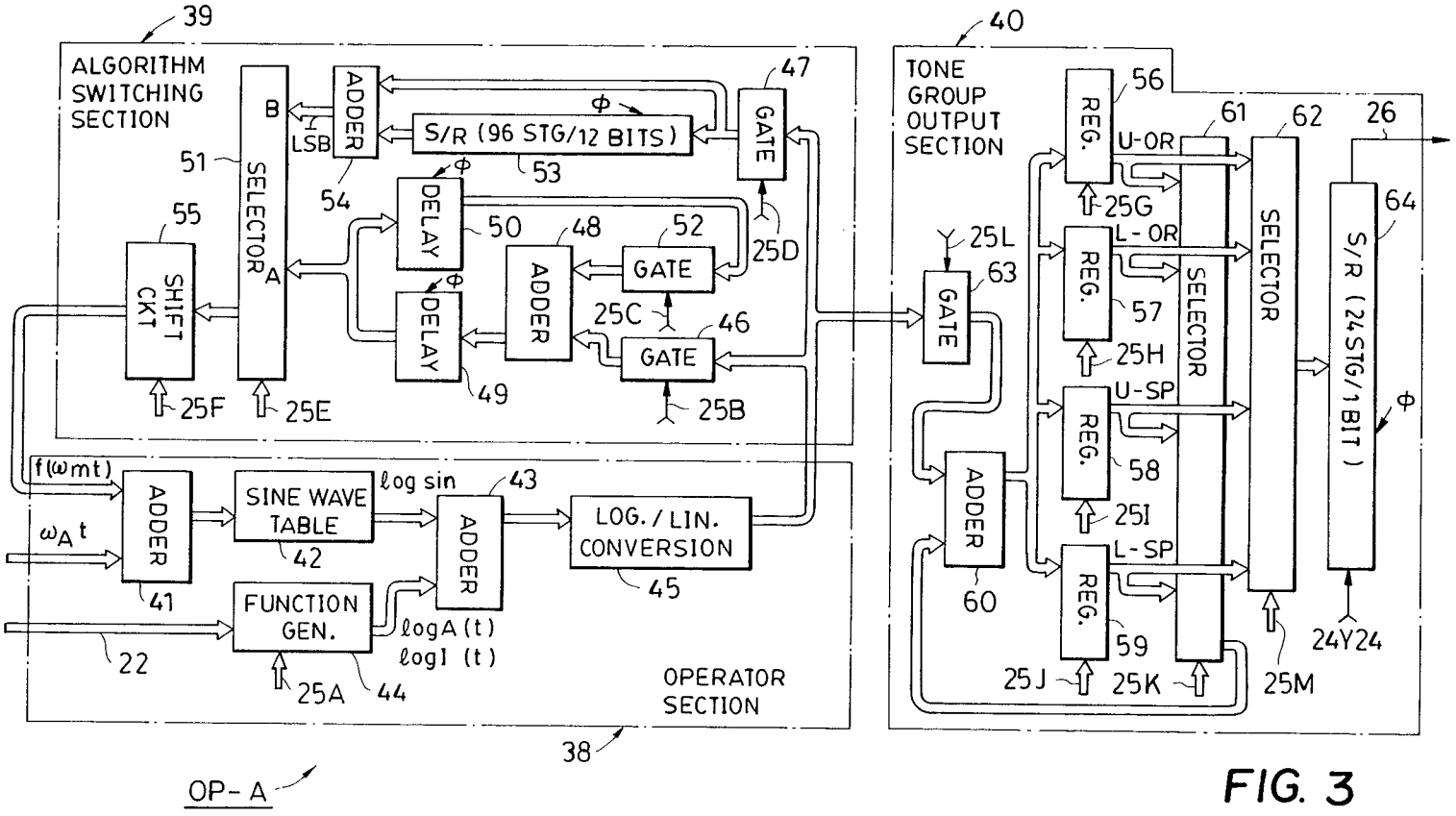
FIG. 3 is a block diagram showing an example of a tone generation operator in FIG. 1.

FIG. 3 shows an example of the tone signal generation operator OP-A using a tone synthesis method based on the frequency modulation operation. Another operator OP-B can be likewise constituted. In FIG. 3, the operator OP-A comprises an operator section 38, algorithm switching section 39 and tone group output section 40. The operator section 38 is provided to execute the basic expressions of the frequency modulation operation for tone generation and uses phase angle information $\omega_A t$ from the phase generator 17 (see FIG. 1) as instantaneous phase angle information of the carrier signal, and given waveform signal $f(\omega_m t)$ supplied from the algorithm switching section 39 as information of the modulating signal, for performing the operation. The operator section 38 is used in time division by 4 time slots to exercise the frequency modulation operation expressions corresponding to the selected tone colors. Specifically, the 8 time slots constituting one word time are used alternately, i.e., 4 time slots for one tone, to carry out the tone synthesis. Thus, by using the time slots alternately, it is possible to synthesize 2 different tone signals, of the orchestra tones O and special tones S, for instance, in one word time (8 time slots) during which one instantaneous phase angle information $\omega_A t$ corresponding to one key code $KC_A$ sustains. FIG. 2 shows the 9th word time on an enlarged scale. The algorithm switching section 39 is a circuit for switching the algorithms of the frequency modulation operation expression, which is executed using 4 time slots, in response to the selected tone color. In the operator section 38, an adder 41 adds the instantaneous phase angle information $\omega_A t$ of the tone to be sounded and a given waveform signal $f(\omega_m t)$ supplied from the algorithm switching section 39. A sine wave table 42 reads the value of the sine function, with the output of the adder 41 as an address signal. Therefore, the sine wave table 42 reads the instantaneous amplitude value of a frequency-modulated signal:

$$\sin\{\omega_A t + f(\omega_m t)\}$$

To simplify the operation circuit by replacing the multiplication of the linear values with addition of logarithms, the sine wave table 42 stores the logarithmic values of the sine function. As is known, when the waveform signal $f(\omega_m t)$ added as the modulating signal to the adder 41 is 0, the value of the sine function is read only according to the phase angle information $\omega_A t$ so that the sine wave table 42 reads the sine wave signal sine $\omega_A t$.

An adder 43 is a scaler means for multiplying the waveform signal read form the sine wave table 42 by an amplitude coefficient. Since, as mentioned previously, the waveform signal read from the sine wave table 42 is expressed in logarithmic form, the addition by the adder 43 brings about effects equivalent to those by the multiplication of the linear values. One input of the adder 43 is provided with the output of the sine wave table 42 and the other input with an amplitude coefficient A(t) or modulation exponent I(t) from a function generator 44. While the amplitude coefficient A(t) and the modulation exponent I(t) refer to the same coefficient for controlling the waveform signal level, the coefficient is called modulation index I(t) when the operator section 38 is functioning to generate the modulating signal and the amplitude coefficient A(t) when the operator section 38 is functioning otherwise.

The function generator 44 is provided, among others, with the key-on signal, which indicates depression and release of the keys assigned from the key assigner 14 through the line 22 to the respective word times (tone generation channels). The generator 44 is also provided at predetermined timings with the parameter signals relating to the tone colors selected in response to the upper keyboard orchestra tones U-OR, lower keyboard orchestra tones L-OR, upper keyboard special tones U-SP, and the lower keyboard special tones L-SP from the timing signal and parameter generator 24 through the line 25 and its divisional line 25A.

Figure 4:
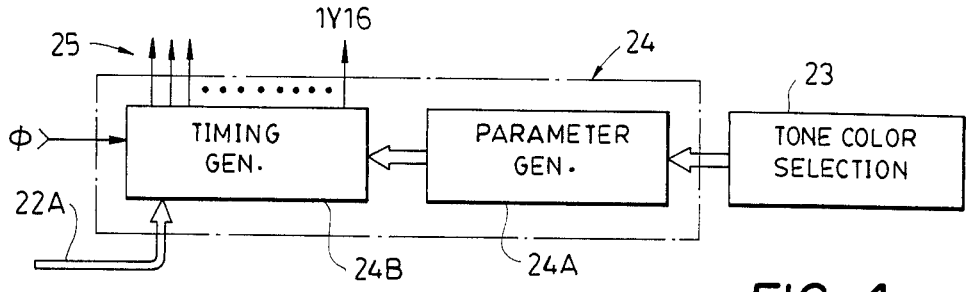
FIG. 4 is a block diagram showing an example of a timing signal and parameter generator in FIG. 1.

As shown in FIG. 4, the timing signal and parameter generator 24 comprises a parameter generator 24A and a timing generator 24B. Parameter signals are generated by the parameter generator 24A according to the tone colors and effects selected at the tone color selection device 23 for the respective tone groups, and supplied to the timing generator 24B. The timing generator 24B delivers these parameter signals through the line 25 at the respective predetermined timings. Further the timing generator 24B is used in the operators OP-A to OP-C, channel divider 29, and a digital to analog conversion circuit 30 to control various operations and, also, generates various timing signals 1Y16 and the like of which the signal generation timings are predetermined. The key assigner 14 supplies signals, which indicate whether the keys assigned to the respective tone generation channels (word times) in the route A belong to the upper keyboard or lower keyboard, through the line 22A to the timing generator 24B. In response to these signals, the timing generator 24B recognizes the word times to which the upper and lower keyboard keys are asisgned and delivers the parameter signal and the timing signal for the upper keyboard and the like signals for the lower keyboard at the respective timings corresponding to the word times to which the keys of those keyboards are assigned.

The parameter signals supplied from the timing generator 24B through the lines 25 and 25A to the function generator 44 shown in FIG. 4 are made distinctive in respect of the keyboards as stated above. Consequently, the parameter signals relating to the tone colors selected in response to the respective tone groups U-OR, L-OR, U-SP, L-SP in the route A are supplied to the function generator 44 at suitable timings for forming tone signals corresponding to those tone groups. In response to the key-on signal form the line 22, the function generator 44 generates coefficient signals of the function forms (generally envelope waveforms) for an appropriate length of time corresponding to the parameter signals supplied from the line 25A. In a typical example of coefficient signal generation in one word time, 3 different modulation index signals I(t) and one amplitude coefficient signal A(t) corresponding to the orchestra tones O are generated in order at the 1st, 3rd, 5th, 7th time slot and 3 different modulation index signals I(t) and one amplitude coefficient signal A(t) corresponding to the special tones S are generated in order at the 2nd, 4th, 6th and 8th time slots. As a matter of course, some of the coefficients A(t) and I(t) may be timewise constant.

It is assumed that the amplitude coefficient A(t) and the modulation exponent I(t) generated by the function generator 44 are also expressed in logarithmic form. Therefore, by addition of logarithmic values, the adder 43 delivers the product of the output waveform signal of the sine wave table 42 and the coefficient:

$$I(t)\sin\{\omega_A t + f(\omega_m t)\} \text{ or}$$

$$A(t)\sin\{\omega_A t + f(\omega_m t)\}$$

in logarithmic form. The signal in logarithmic form produced from the adder 43 is converted into a signal expressed in linear form by a logarithm/linear conversion table 45.

It is assumed that there is provided a one-time-slot delay between the input and output in the operator section 38. For instance, the result of operation relating to the phase angle information $\omega_A t$ applied to the adder 41 at the timing of a certain time slot in one word time is produced from the logarithm/linear conversion table 45 one time slot later.

The output signal of the logarithm-linear conversion table 45 is applied to gates 46 and 47 of the algorithm switching section 39. The output of the gate 46 is added to one input of an adder 48 whose output in turn is added to a delay circuit 49 which effects one-time-slot delay. The output of the delay circuit 49 is added to a delay circuit 50 which effects a one-time-slot delay and the A input of a selector 51. The output of the delay circuit 50 is applied to the other input of the adder 48. The output of the gate 47 is added to one input of an adder 54 and to the other input of the adder 54 through a 96-stage shift register 53. The output of the adder 54 is shifted right by one bit or halved as its least significant bit LSB is discarded, and applied to the B input of the selector 51. The output of the selector 51 is added to the adder 41 of the operator section 38 as a modulating signal f ($\omega_m t$) after being shifted by a shift circuit 55.

A predetermined signal among the parameter signal and the timing signal provided from the timing generator 24B (see FIG. 4) to the line 25 is supplied through the lines 25B, 25C, 25D, 25E, 25F as a control signal for gates 46, 47, 52, as a selection control signal for the selector 51 and as a shift amount control signal for the shift circuit 55. According to the selected tone color, the gates 46, 47, 52 are opened at predetermined timings, a predetermined input A or B is selected at the selector 51 and a numerical value shift is effected by a predetermined amount by the shift circuit 55 to discretionally control the algorithm of the frequency modulation operation corresponding to said tone color.

Where the output signal of the operator section 38 at a certain time slot is used as it is as the modulating signal $f(\omega_m t)$ at the next time slot, the gate 46 is opened while the gate 52 is closed so that the output signal of the operator section 38 is led to the delay circuit 49 through the gate 46 and adder 48 and, one time slot later when said signal is produced by the delay circuit 49, the A input is selected at the selector 51. In this case, the signal supplied as the modulating signal $f(\omega_m t)$ is 2 time slots behind the input timing of the operator section 38 due to the one-time-slot delay in the operator section 38 and the another one-time-slot delay in the delay circuit 49. Since, as mentioned before, the operation timings in the operator section 38 for the orchestra tones O and the special tones S are set alternately, each at every other time slot, the 2-time-slot delay of the modulating signal $f(\omega_m t)$ ensures the operation involving the tone signals belonging to the same tone groups (i.e., orchestra tone signals with another orchestra tone signals or special tone signals with another special tone signals). More specifically, in one word time (8 time slots) during which one instantaneous phase angle information $\omega_A t$ is sustained, it is made possible using this information $\omega_A t$ to synthesize 2 different tone signals for 2 tone groups of the orchestra tones O and special tones S by using 8 operation time slots in time division, 4 time slots for each alternately.

Where the signal obtained by adding the output signals of the operator section 38 at two different time slots is used as the modulating signal $f(\omega_m t)$, the gates 46 and 52 are opened. When the output signal of the operator section 38 at a given time slot is supplied to the gate 46, the output signal of the operator section 38 at the preceding time slot by two time slots (i.e., the output signal of the adder 48) is supplied from the delay circuit 50 to the gate 52. Accordingly, signals belonging to the same tone group (orchestra tones O or special tones S) are supplied through the gates 46 and 52 to the adder 48 and added there.

Alternatively, the gate 46 may be closed and the gate 52 opened so as to pass the output signal of the delay circuit 50 through the adder 48 and delay circuit 51 to obtain the modulating signal $f(\omega_m t)$. The shift circuit 55 is provided to control the degree of modulation through the level shift of the modulating signal $f(\omega_m t)$.

The gate 47, shift register 53 and adder 54 are provided to feed back the result of operation in the operator section 38 relating to a given time slot as the modulating signal $f(\omega_m t)$ for the operation relating to the same time slot. When the signal to be fed back as the modulating signal relating to the same time slot is provided from the operator section 38, the gate 47 is opened and its output signal is applied to the adder 54 and shift register 53. The signal supplied to the shift register 53 is delayed by 96 time slots at the clock pulse $\phi$ and appled to the adder 54. Therefore, the adder 54 is supplied with the present output signal of the operator section 38 and the output signal of the operator section 38 preceding the present signal output by one cycle, both relating to the same time slot. When the output signal of the adder 54 is applied to the selector 51, it is shifted right by one bit. This means that the selector 51 is virtually provided with the average value of the present and the preceding outputs of the operator section 38. The selector 51 selects the B input according to the signal through the line 25E at a given timing and feeds back the average value signal to the operator section 38 as the modulating signal $f(\omega_m t)$ for the operation relating to the same time slot.

The tone group output section 40 is provided to reclassify into tone groups the word-time-wise digital tone signals which were synthesized by the operator section 38 and algorithm conversion section 39 and produces the reclassified tone signals in time division and serially at the timings of the respective tone groups U-OR, L-OR, U-SP and L-SP shown in the row OP-A in FIG. 2. Registers 56 to 59 are provided in respect of the 4 tone groups U-OR through L-SP. These registers are supplied with signals for controlling the loading of the supplied signals and the clearing of stored contents from the timing generator 24B (see FIG. 4) through the lines 25 and 25G, 25H, 25I, 25J. The output signals of the registers 56 to 59 are applied to selectors 61 and 62.

The selection control signal for the selector 61 is supplied from the timing generator 24B (FIG. 4) through the lines 25 and 25K. The output of the selector 61 is applied to one input of an adder 60. The other input of the adder 60 is supplied with the output signal of the operator section 38 through a gate 63. The control signal for the gate 63 is supplied from the timing generator 24B through the lines 25 and 25L. At the time slots at which the orchestra and special tone synthesis operations are each completed in every word time, the gate 63 is opened so the digital tone signal at one sample point is applied to the adder 60. At this time, the output signal of the register (one of the registers 56 to 59) for the tone group to which the tone signal selected by the gate 63 belongs is selected by the selector 61 and applied to the adder 60. The output of the adder 60 is loaded in the register (one of the registers 56 to 59) for the same tone group selected at the selector 61. Thus, in one sampling cycle, the tone signals of the same tone group are successively added and held in the registers 56 to 59. On completion of said successive addition in one sampling cycle, the output signals of the respective registers 56 to 59 are loaded in a shift register 64 through the selector 62. The successive addition completion timing for one sample point differs among the registers 56 to 59 and corresponds to the load timing of the shift register 64 to be described. When the result of addition for one sample point in a given register (one of the registers 56 to 59) is loaded in the shift register 64, the stored contents of that register is cleared. The control signals supplied to the lines 25G to 25L are generated at appropriate timings depending on the tone colors selected in the respective tone groups and on whether the key assigned to every word time belongs to the upper or lower keyboard.

The selector 62 is provided to time division multiplex the tone signals of the respective tone groups U-OR to L-SP at intervals of 24 time slots. The timing signal for controlling the time division multiplexing is supplied from the timing generator 24B (see FIG. 4) to the selector 62 through the lines 25 and 25M. In a given 24-time-slot interval of one sampling cycle, the output signal of the register 56 corresponding to the tone group U-OR is selected and, in the next 24-time-slot interval, the output signal of the register 57 corresponding to the tone group L-OR is selected and, in the next 24-time-slot interval and the following 24-time-slot interval, the output signals of the registers 58 and 59 each corresponding to the tone groups U-SP and L-SP are selected respectively.

The output of the selector 62 is applied to a parallel-input serial-output type shift register 64. The selector 62 provides the digital tone signals of the 4 tone groups U-OR to L-SP in time division, each in 24 time slots. The digital tone signal, which consists of 24 bits, is applied in parallel to the 24-stage/1-bit shift register 64, and sequentially shifted in response to the clock pulse $\phi$. As a result, a serialized digital tone signal is supplied from the final stage of the shift register 64 to the output line 26 in 24 time slots. The load control input of the shift register 64 is supplied with the timing signal 24Y24. As shown in FIG. 2, the timing signal 24Y24 generates pulses, each lasting for one time slot, at the 24th, 48th, 72nd and 96th time slot.

When the timing signal 24Y24 has generated a pulse at the 96th time slot, the tone signal of the tone group U-OR or upper keyboard orchestra tones is loaded in the shift register 64 which, in the succeeding 24 time slots, serially delivers the tone signal of the tone group U-OR to the line 26. When the signal 24Y24 has generated a pulse at the 24th time slot, the tone signal of the tone group L-OR or upper keyboard orchestra tones is loaded in the shift register 64 which produces the tone signal serially in the succeeding 24 time slots. The tone signals of the other tone groups U-SP, L-SP are likewise serialized so the tone signals of the respective tone groups U-OR to L-SP are time division multiplexed at intervals of 24 time slots and delivered timewise serially in 24-time-slot intervals.

Description will now be made as to the representation of the timing signals in the specification and drawings. The numeral after "Y" indicates the period of the timing signal represented whereas the numeral before "Y" indicates the pulse generation timing in that period. Accordingly, the timing signal 1Y16, as shown in FIG. 2, generates a pulse at the first time slot in every period of 16 time slots (i.e., the first, 17th, 33rd, 49th, 65th, 81st time slot). Where, as in the case of 1T3Y16 shown in FIG. 2, a pulse lasts for more than one time slot, an indication containing "T" is added before "Y" to show the span of the pulse. Thus the timing signal 1T3Y16 has a period of 16 time slots and the pulse it generates in every period lasts from the first to the third time slot. In FIG. 2, the numerals given above the pulses of the timing signals show their ordinal numbers in one cycle.

Figure 5:
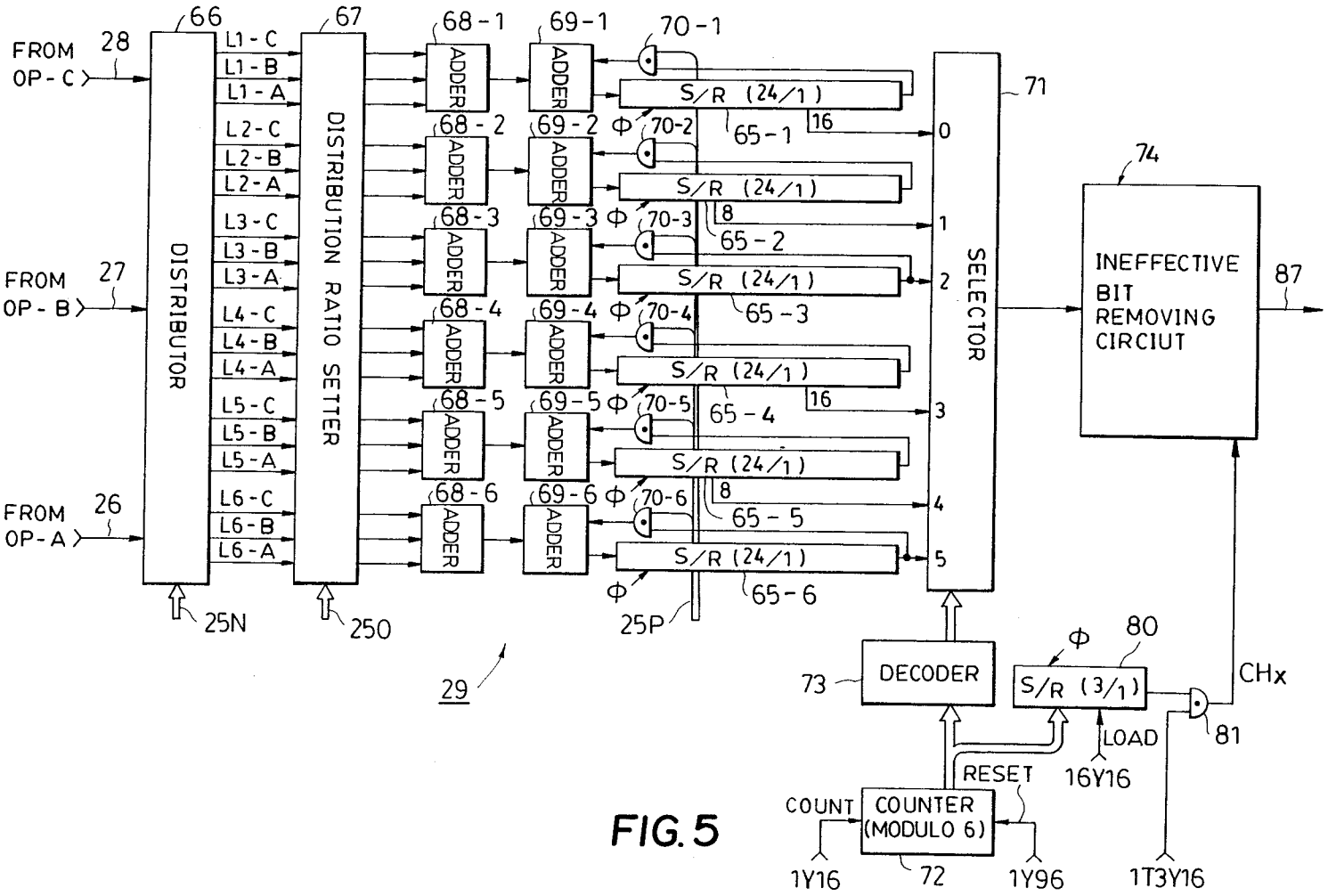
FIG. 5 is a block diagram showing an example of a channel divider in FIG. 1.

FIG. 5 shows an example of the channel divider 29. Six 24-stage/1-bit type shift registers 65-1 to 65-6 correspond to the 6 channels which enable the digital-to-analog conversion circuit 30 (FIGS. 1 and 6) to be used in time division. These shift registers are provided to store the 6 tone groups of tone signals which were reclassified in the channel divider 29 so as to correspond to the respective channels. A distributor 66 is provided to distribute the 10 tone groups of serial tone signals supplied from the operators OP-A to OP-C through the lines 26, 27, 28 to the 6-digital-to-analog conversion channels or the shift registers 65-1 to 65-6. The signals through the lines 26 to 28 are applied to the distributor 66 and thereby distributed in response to the control signal from the line 25N into either of the output line groups, each consisting of 6 different lines, namely L1-A to L6-A, L1-B to L6-B and L1-C to L6-C. Referring to the representation of these output lines, L1 to L6 indicate correspondence with the respective 6 digital-to-analog conversion channels whereas A to C show correspondence with the tone generation routes A to C (input lines 26 to 28). The line 25N is one of the lines 25 from the timing generator 24B (see FIG. 4). The line 25N is supplied with a control signal in response to which the signals through the input lines 26 to 28 are distributed in a given manner to the output lines L1-A to L6-C according to the tone colors selected in the respective tone groups.

For example, where 10 digital type tone groups are to be reclassified into 6 analog type tone groups as shown in the table below, in the 24-time-slot interval during which the serial tone signals of the tone group U-OR are supplied to the input line 26, these signals are distributed to the output lines L1-A, L4-A, L6-A, and in the 24-time-slot interval during which the tone signals of the tone group L-OR are supplied to the input line 26, these signals are distributed to the output line L6-A, and in the 24-time-slot during which the tone signals of the tone group SOLO are supplied to the input line 27, these signals are distributed to the output line L3-B. The manner of distribution for the tone signals of the other tone groups will be obvious from Table 1.

TABLE 1

Example of Tone Group Reclassification

| Digital type | Analog type (channels) | |
|---|---|---|
| U-SP, U-OR | R | (1) |
| U-CUS | MOD | (2) |
| SOLO | SOLO | (3) |
| ARP, P, U-OR | C | (4) |
| RHM I, RHM II | RHM | (5) |
| L-SP, L-OR, U-OR | L | (6) |

As mentioned previously, the manner of reclassification into tone groups is not limited to that shown in Table 1 but varies depending on the tone color selected. The distribution manner in the distributor 66 also varies accordingly.

A distribution ratio setter 67 is provided to variably set the ratio of the amplitude levels of the tone signals to be distributed to the respective channels (analog type tone groups) in respect of the individual tone groups (10 tone groups). This ratio of distribution is controlled by the control signal provided through the line 250 in respect of each of the 18 input lines L1-A to L6-C and in respect of each of the time division timing in every 24-time-slot interval. As described earlier, the line 250 is one of the output lines 25 from the timing generator 24B and supplied with the control signal (parameter signal) for setting any distribution ratio in response to the tone color selected in each of the tone groups (10 tone groups). The distribution ratio setter 67 functions as a multiplier to control the level of the tone signals of the input lines L1-A to L6-C according to the control signal supplied through the control line 250. More specifically, in the 24-time-slot period required for delivering a unit serial tone signal which is supplied from each of the operators OP-A to OP-C to the lines 26 to 28, data is serially delivered successively from the least significant bit. The distribution ratio setter 67 comprises a delay circuit which effects a sequential delay of a few time slots in individual correspondence with the respective input lines L1-A to L6-C, and a selector which selects the output of any delay stage of this delay circuit. This selector selects the output of a proper delay stage according to the ratio setting parameter provided through the line 250. Due to the bit order of the serial tone signals starting from the least significant bit, delaying thereof by one time slot means doubling its value and delaying by 2 time slots means quadrupling. Thus the distribution ratio of the respective tone signals of the lines L1-A to L6-C is set by delaying the serial tone signals by one or more time slots or not at all.

Adders 68-1 to 68-6 and 69-1 and 69-6 are provided to add and mix one or more tone signals distributed to the respective channels. The three signal lines from the disbritution ratio setter 67 to the respective channels are connected to the adders 68-1 to 68-6 provided for the respective channels. In these adders 68-1 to 68-6, the tone signals of the tone generation routes A to C distributed to the respective channels at the same timing are added in the respective channels. The outputs of the adders 68-1 to 68-6 are applied to the corresponding adders 69-1 to 69-6. The outputs of the adders 69-1 to 69-6 are applied to the corresponding shift registres 65-1 to 65-6 and shifted successively according to the clock pulse $\phi$. The outputs of the last stages of the shift registers 65-1 to 65-6 are added to the other inputs of the adders 69-1 to 69-6 through corresponding AND gates 70-1 to 70-6. The AND gates 70-1 to 70-6 are controlled by the control signal supplied from the timing generator 24B (see FIG. 4) through the lines 25 and 25P. These AND gates 70-1 to 70-6 are enabled in a predetermined 72-time-slot interval in one sampling cycle and disabled in the remaining 24-time-slot interval. The timings at which the respective AND gates 70-1 to 70-6 are disabled are in shifted relation by 16 time slots relative to one another according to the selection timings in a selector 71 of the output signals of the shift registers 65-1 to 65-6.

In the 24-time-slot interval in which the AND gate 70-1 is disabled, the serial tone signal produced by the adder 68-1 is loaded in the shift register 65-1 through the adder 69-1. In the next 24-time-slot interval, the serial tone signal of 24 bits successively produced from the last stage of the shift register 65-1 is added to the adder 69-1 through the AND gate 70-1 and added to the 24-bit serial tone signal supplied from the adder 68-1. The result of addition is loaded in the shift register 65-1. Thus the four serial tone signals produced from the adder 68-1 at different timings (four 24-time-slot intervals) in one sampling cycle are accumulated in the loop formed by the adder 69-1 and shift register 65-1 so that finally, i.e., immediately before the AND gate 70-1 is disabled, the sum of the tone signals of all tone groups to be distributed and assigned to the pertinent channels (analog type tone groups) is loaded in the whole 24 stages of the shift register 65-1. The accumulation operation is likewise performed by the adders 69-2 to 69-6 and shift registers 65-2 to 65-6 for the other channels. The adders 68-1 to 68-6, 69-1 to 69-6, it is noted, are serial adders and comprise the functions of supplying a carry signal after delaying it to the next time slot (i.e., the next bit at the left) and prohibiting the carry signal at the timings at which the serial tone signals change from one to another.

The selector 71 is provided to serially select the output signals of the shift registers 65-1 to 65-6 corresponding to the respective channels (analog type tone groups R, MOD, SOLO, C, RHM and L) in time division at the timings shown in the row DAC in FIG. 2. The selection is controlled by a counter 72. The counter 72, a modulo 6 counter, is reset periodically at the beginning of every sampling cycle in response to the timing signal 1Y96 (see FIG. 2) and increases its value by 1 in every 16 time slots in response to the timing signal 1Y16 (see FIG. 2). The output of the counter 72 is decoded by a decoder 73 and used as a selection control signal in the selector 71.

The selector 71 is provided at its input 0 with the output from the 16th stage of the shift register 65, at its input 1 with the output from the 8th stage of the shift register 65-2, at its input 2 with the output from the 24th stage of the shift register 65-3, at its input 3 with the output from the 16th stage of the shift register 65-4, at its input 4 with the output from the 8th stage of the shift register 65-5, and at its input 5 with the output from the 24th stage of the shift register 65-6. The selector 71 selects the input 0 when the output of the decoder 73 (i.e., the value of the counter 72) is "0" and selects the input 1, 2, 3, 4, 5 when the output is "1", "2", "3", "4", "5", respectively. Thus the outputs of the shift registers 65-1 to 65-6 (corresponding to the tone groups R, MOD, SOLO, C, RHM, L) are selected sequentially, each in a 16-time-slot interval, at timings shown in the row DAC channel in FIG. 2.

Suppose at the first time slot in one sampling cycle, the shift register 65-1 has all the 24 bits showing the final addition result for one sample point in its whole 24 bits. Just at this time, due to the bit order of the serial tone signals starting with the least significant bit as mentioned before, the shift register 65-1 has the 16 bits including MSB and consecutive high order bits relating to the final addition result in its first to 16th stages. Therefore, when the input 0 is selected in the selector 71 from the first to the 16th time slot, the 16 high order bits relating to the final addition result are sequentially delivered from the 16th stage of the shift register 65-1, the least significant bit among them first, and the serial tone signal of these 16 bits is selected and produced by the selector 71. The outputs from the predetermined stages of the other shift registers 65-2 to 65-6 are connected, as described earlier, to the respective inputs of the selector 71 so that the 16 high order bits relating to the final addition results of the shift registers 65-2 to 65-6 may be selected by the selector 71 through the inputs 1 to 5 at timings shifted from one another by 16 time slots.

The output of the selector 71 may be delivered directly to the digital-to-analog conversion circuit 30 (see FIG. 1), effecting digital-to-analog conversion in the respective channels in time division using a digital-to-analog converter capable of converting a 16-bit digital signal to an analog signal. In this embodiment, however, the 16-bit digital signal delivered from the selector 71 is divided into a 10-bit mantissa section and a 3-bit exponent section so that a 10-bit input type small-sized digital-to-analog converter may be used, thereby further simplifying the structure of the digital-to-analog converter. For that purpose, an ineffective bit removing circuit 74 is provided.

Figure 6:
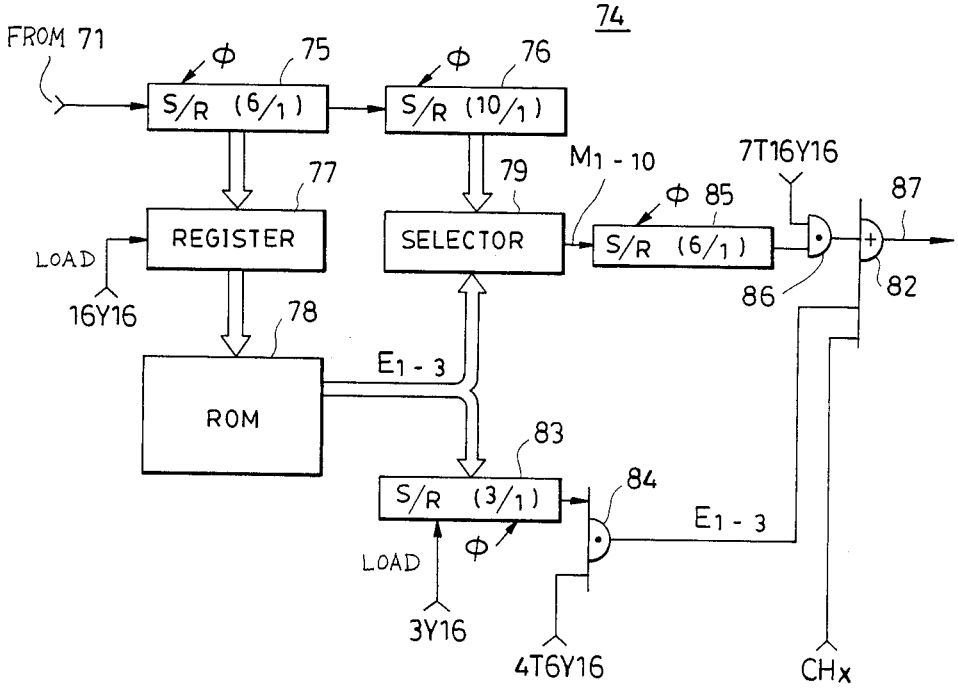
FIG. 6 is a block diagram showing an example of an effective bit removing circuit in FIG. 5.

In the ineffective bit removing circuit 74 shown in FIG. 6, a 6-stage/1-bit shift register 75 and a 10-stage/1-bit shift register 76, both shift controlled by the clock pulse $\phi$, are provided in series. The output of the selector 71 (see FIG. 5) is applied to the first stage of the shift register 75. The output from the respective stages of the shift register 75 are applied to the register 77 in parallel. The register 77 is load controlled in every 16 time slots by the timing signal 16Y16 (see FIG. 2). When the 16-bit digital tone signal relating to a certain channel has just entered the whole stages, the load control signal 16Y16 is supplied to the register 77 and the output of the shift register 75 is loaded in the register 77. Therefore, the 6 higher bits of the digital tone signal is stored in the register 77. The output of the register 77 is inputted to an ROM (read only memory) 78 as an address signal. Based on the state of data of the 6 most significant bits of the digital tone signal, the ROM 78 detects the ineffective bits located in higher bit positions in that digital tone signal and reads exponent section data $E_{1-3}$ according to the number of the higher ineffective bits.

The outputs of all the stages of the shift register 76 are applied to a selector 79. The selection control input of the selector 79 is supplied with the exponent section data $E_{1-3}$ that was read from the ROM 78. The selector 79 selects the output from one of the stages of the shift register 76 according to the data $E_{1-3}$ and produces mantissa section data $M_{1-10}$. Since the exponent section data $E_{1-3}$ indicates the number of the higher ineffective bits, the 10 higher bits out of those from which the higher ineffective bits have been deleted, that is, the effective bits, are used as mantissa section data $M_{1-10}$.

TABLE 2

| ROM 78 | | | | | | | | | |
|---|---|---|---|---|---|---|---|---|---|
| Input (6 higher bits) | | | | | | Output ($E_{1-3}$) | | | |
| SB | MSB | | | | | Binary | | | Decimal |
| 0 | 0 | 0 | 0 | 0 | 0 | 1 | 0 | 1 | 5 |
| 0 | 0 | 0 | 0 | 0 | 1 | 1 | 0 | 0 | 4 |
| 0 | 0 | 0 | 0 | 1 | — | 0 | 1 | 1 | 3 |
| 0 | 0 | 0 | 1 | — | — | 0 | 1 | 0 | 2 |
| 0 | 0 | 1 | — | — | — | 0 | 0 | 1 | 1 |
| 0 | 1 | — | — | — | — | 0 | 0 | 0 | 0 |
| 1 | 0 | — | — | — | — | 0 | 0 | 0 | 0 |
| 1 | 1 | 0 | — | — | — | 0 | 0 | 1 | 1 |
| 1 | 1 | 1 | 0 | — | — | 0 | 1 | 0 | 2 |
| 1 | 1 | 1 | 1 | 0 | — | 0 | 1 | 1 | 3 |
| 1 | 1 | 1 | 1 | 1 | 0 | 1 | 0 | 0 | 4 |
| 1 | 1 | 1 | 1 | 1 | 1 | 1 | 0 | 1 | 5 |

Table 2 shows an example of input and output table for the ROM 78. SB represents the sign bit and MSB the most significant bit. The sign bit SB indicates "positive" when it is "0" and "negative" when "1". The negative values are here supposed to be expressed in the 2's complement form. The smaller the absolute value of the amplitude value, the greater the number of the higher ineffective bits of the tone signal whereas the greater the absolute value of the amplitude value, the smaller the number of the higher ineffective bits of the tone signal. In a positive value, its effective or substantial value is represented by the leftmost bit "1" (as viewed in the table) and those bits located at the right of it. The bit "0" located immediately at the left of said leftmost bit "1" is necessary as sign bit. Thus the second bit to the left from said leftmost bit "1" and all other bits located further leftward are the ineffective bits. Accordingly, in positive values, the ineffective bits can be detected at once by locating the leftmost bit "1". Where, for instance, the 6 higher bits of a tone signal are "000001", the 4 higher bits are the ineffective bits. As obvious from this, the detection of the ineffective bits of a positive 6-bit signal is limited to 6 patterns since in the case of such a signal, the leftmost "1" may be located either at the second bit from the left (MSB), or at the third, fourth, fifth or sixth bit from the left or all the bits are 0s. The detection of ineffective bits of a negative 6-bit signal is likewise limited to 6 patterns (in this case, since "1" and "0" replace each other, detection is based on the position of the leftmost "0"). Accordingly, the ineffective bit detection table for the ROM 78 is as shown in Table 2 and 3-bit binary signals "000" to "101" ("0" to "5" in decimal) showing the number of the ineffective bits are read as exponent section data $E_{1-3}$. For instance, when the 6 higher bits are "0001--" ("-" indicates that the bit at that position can be either "1" or "0"), exponent section data $E_{1-3}$ indicating that the number of the ineffective bits is 2 is read.

The tone signals, each consisting of 16 bits following one after another in order with the least significant bit first, are shifted sequentially through the shift registers 75 and 76. In order to isolate exponent section data $E_{1-10}$ for 10 bits in a given 10-time-slot interval, the output signal is isolated from different stages of the shift register 76 according to the number of ineffective bits to be removed. When, for instance, the decimal value of exponent section data $E_{1-3}$ is "0", meaning there are no leftward ineffective bits to be removed, the 10 higher bits are selected as exponent section data $E_{1-3}$ at the selector 79. For that purpose, the output from the 4th stage of the shift register 76, for instance, is selected in response to "0" of $E_{1-3}$ such that when the 16-bit tone signal for one channel has entered the whole stages of the shift registers 75, 76 (16 stages in all), data of the 10 higher bits located in the whole 6 stages of the shift register 75 and the first 4 stages of the shift register 76 is isolated serially in a 10-time-slot interval from the 4th stage of the shift register 76, the least significant bit first. Likewise the selector 79 performs selection operation such that as the decimal value of the exponent section data $E_{1-3}$ increases, the output may be isolated from the later stage of the shift register 76 (for instance, when the decimal value of said data is "1", the output is isolated from the 5th stage; when "2", from the 6th; and when "3", from the 7th).

Figure 7:
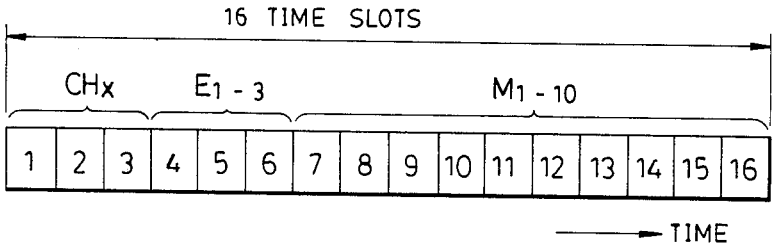
FIG. 7 is a time chart showing a state of signals for one channel provided from the ineffective bit removing circuit in FIG. 6.

The ineffective bit removing circuit 74 delivers mantissa section data $M_{1-10}$, exponent section data $E_{1-3}$, and channel number data CHx serially in the form shown in FIG. 7. Specifically, in a 16-time-slot interval required for delivering serial data for one channel, the circuit 74 serially delivers 3-bit channel number data CHx in the first 3 time slots and 3-bit exponent section data $E_{1-3}$ in the next 3 time slots, and 10 bit mantissa section data $M_{1-10}$ in the remaining 10 time slots. For serial delivery of channel number data CHx, a parallel-input serial-output type 3-stage/1-bit shift register 80 is provided in association with the counter 72 shown in FIG. 5. The shift register 80 is loaded with the output signal of the counter 72 in parallel in response to the timing signal 16Y16 and provides a serial output according to the clock pulse $\phi$. The output signal of the shift register 80 is added to an AND gate 81 and selected in the first 3 time slots of the 16-time-slot intervals in the respective channels in response to the timing signal 1T3Y16 (see FIG. 2). Since the output of the counter 72 controls selection by the selector 71, the 3-bit value of the counter 72 indicates the channel number of each time division channel timing (16-time-slot interval). Accordingly, the AND gate 81 produces a signal obtained by serializing 3-bit data CHx which indicates the channel number of a pertinent channel timing in the first 3 time slots in that channel timing. The serial channel number data CHx is added to an OR gate 82 (FIG. 6) provided on the output side of the ineffective bit removing circuit 74.

Referring to FIG. 6, the exponent section data $E_{1-3}$ that is read from the ROM 78 is applied in parallel to a 3-stage/1-bit parallel-input serial-output type shift register 83. The shift register 83 is loaded with the output signal of the ROM 78 in response to the timing signal 3Y16 (see FIG. 2) and produces this signal serially in response to the clock pulse $\phi$. The output of the shift register 83 is added to an AND gate 84 and selected in the 3-time-slot interval from the 4th to 6th time slot of the 16-time-slot interval of each channel in response to the timing signal 4T6Y16 (see FIG. 2). The output of the AND gate 84 is added to the OR gate 82. As shown in FIG. 7, therefore, in the first 3 time slots of the 16-time-slot interval for one channel, the OR gate 82 serially produces the 3-bit channel number data CHx that was supplied from the AND gate 81 and in the next 3 time slots, serially produces the 3-bit exponent section data that was supplied from the AND gate 84.

In this example, the mantissa section data $E_{1-10}$ serially delivered from the selector 79 assumes an effective value in the first 10 time slots of the time division timing for one channel (16-time-slot interval). Therefore, the output signal of the selector 79 is delayed by 6 time slots through a 6-stage/1-bit shift register 85 so that effective mantissa section data $M_{1-10}$ may be produced in the last 10 time slots of the 16-time-slot interval for one channel. The output of the shift register 85 is applied to an AND gate 86 which selects effective 10-bit mantissa section data $M_{1-10}$ in the last 10 time slots of the 16-time-slot intervals of the respective channels in response to the timing signal 7T16Y16 (see FIG. 2). The output of the AND gate 86 is added to the OR gate 82. Thus, as shown in FIG. 7, mantissa section data $M_{1-10}$ is serially produced from the OR gate 82 in the 10-time-slot interval immediately after exponent section data $E_{1-3}$ was serially delivered. Accordingly, the OR gate 82 produces serial data CHx, $E_{1-3}$, $M_{1-10}$ in time division for each channel every 16 time slots as shown in FIG. 7. The output of the OR gate 82 is supplied through a line 87 to the digital-to-analog conversion circuit 30 shown in FIG. 8.

Figure 8:
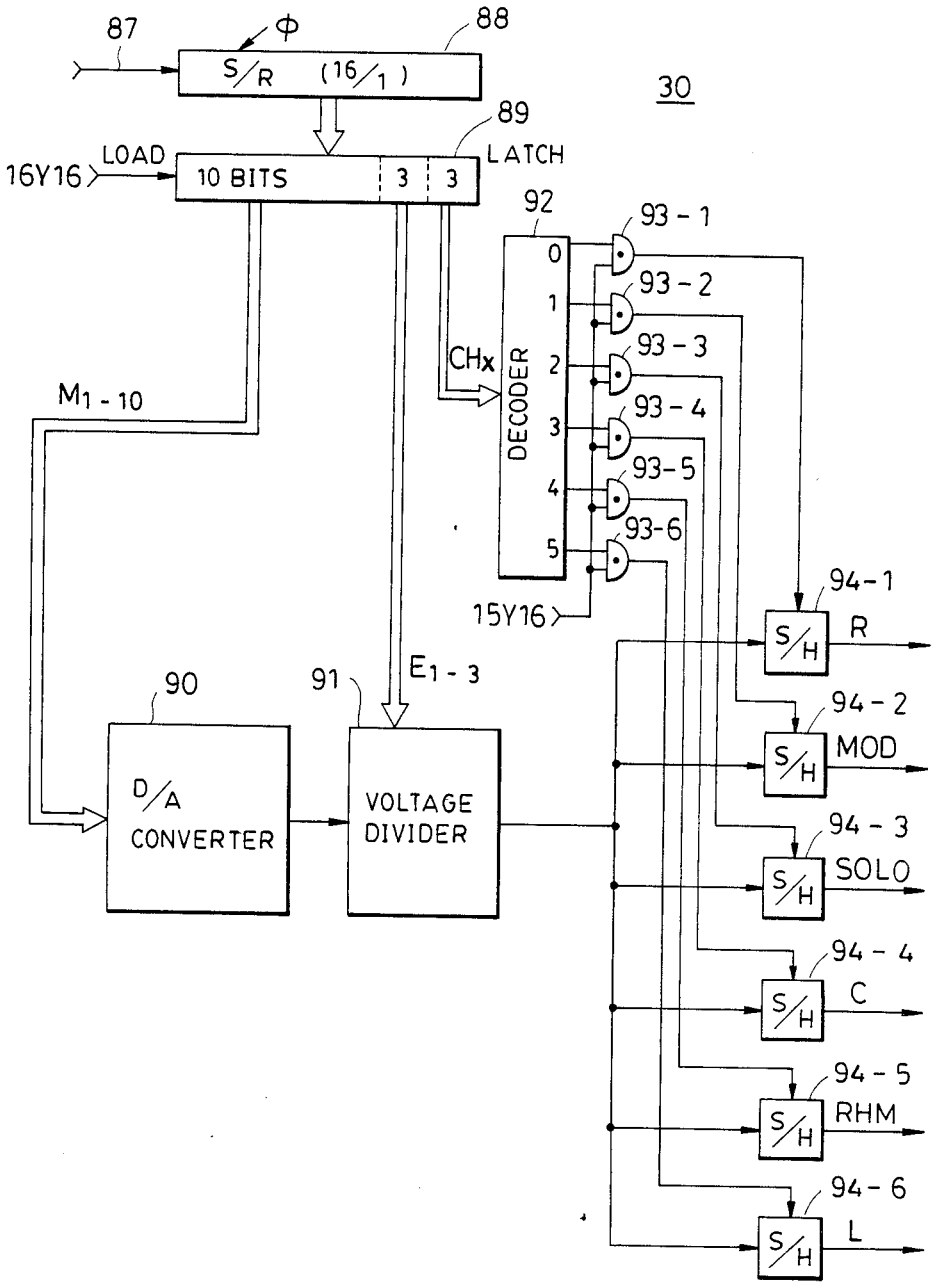
FIG. 8 is a block diagram showing an example of a digital-analog converter in FIG. 1.

Referring to FIG. 8, the serial data supplied from the channel divider 29 through the line 87 (or the output signal of the OR gate 82) is applied to a 16-stage/1-bit shift register 88. The shift register 88 sequentially shifts the applied serial data in response to the clock pulse $\phi$. The outputs from all the stages of the shift register 88 are applied to a latch circuit 89 in parallel. The latch circuit 89 is load controlled repeatedly every 16 time slots in response to the timing signal 16Y16. When serial data for one channel supplied through the line 87 has just entered the whole 16 stages of the shift register 88, the 16-bit data CHx, $E_{1-3}$, $M_{1-10}$ is latched in parallel in the latch circuit 89. The 10-bit mantissa section data $M_{1-10}$ latched in the latch circuit 89 is applied to a digital-to-analog converter 90 and thereby converted to an analog voltage signal. The analog voltage signal produced from the digital-to-analog converter 90 is added to a voltage divider 91 and thereby voltage divided in a voltage dividing ratio corresponding to the exponent section data $E_{1-3}$ supplied from the latch circuit 89. This voltage dividing ratio is set at 1, $\frac{1}{2}$, $\frac{1}{4}$, $\frac{1}{8}$, 1/16, 1/36 against the respective decimal values of the exponent section data $E_{1-3}$ "0", "1", "2", "3", "4", "5". In other words, the voltage divider 91 voltage divides the analog voltage value of the mantissa section data $M_{1-10}$ according to the exponential function of which the base is 2 and the exponent is the number of the higher bits treated as ineffective in selecting mantissa section data $M_{1-10}$, i.e., $2^0$, $2^1$, $2^2$, $2^3$, $2^4$, or $2^5$. As a result, the voltage divider 91 produces an analog voltage signal corresponding to the digital signal obtained by shifting right the mantissa section data $M_{1-10}$ by the number of bits equal to that of the bits treated as ineffective when obtaining the mantissa section data $M_{1-10}$, i.e., the original digital signal signal to be subjected to the digital-to-analog conversion.

The channel number data CHx latched in the latch circuit 89 is decoded by a decoder 92. The six outputs of the decoder 92 are applied respectively to AND gates 93-1 to 93-6. The AND gates 93-1 to 93-6 are provided through their other inputs with the timing signal 15Y16 (see FIG. 2) and at the pulse generation timing of the signal 15Y16, select and supply the outputs of the decoder 92 to the sampling control inputs of the sample hold circuits 94-1 to 94-6. The sample hold circuits 94-1 to 94-6 correspond to the respective channels (6 tone groups R to L). The outputs of the decoder 92 corresponding to the respective channels are the sampling control inputs of the corresponding sample hold circuits 94-1 to 94-6. The analog signal inputs of the sample hold circuits 94-1 to 94-6 are all supplied with the outputs signal of the voltage divider 91. Thus the output analog voltage signal of the voltage divider 91 is sampled in a sample hold circuit (one of the circuits 94-1 to 94-6) and held therein until the next sampling timing arrives, that is, for one sampling cycle (96 time slots). Thus the tone signal of the respective channels (tone groups R, MOD, SOLO, L, RHM, L), converted to an analog signal in time division during one sampling cycle, are held in the respective sample hold circuits 94-1 to 94-6 and delivered as sustaining analog tone signals.

What is claimed is:

1. An electronic musical instrument comprising:

tone generation means having a plurality of tone generation channels each of which generates a digital tone signal in reponse to operation of a key or a switch;

dividing means for dividing the digital tone signals generated by said tone generation means into at least two groups;

mixing means for mixing the digital tone signals of each of said groups and for delivering the mixed signals, said mixed signals corresponding to said groups respectively;

multiplexing means for time division multiplexing said mixed signals and for delivering said mixed signals on a time division basis;

digital-to-analog conversion means for converting the delivered time division multiplexed mixed signals to analog signals respectively; and sample and hold means having sample and hold circuits corresponding to said groups, each of which samples and holds only that one analog tone signal for corresponding group.

2. An electronic musical instrument as defined in claim 1 which further comprises tone color selecting means for independently selecting tone colors to be imparted to said digital tone signals respectively and wherein said dividing means divides said digital tone signals into said groups according to said tone colors.

3. An electronic musical instrument as defined in claim 1 wherein said mixing means comprises:

mixing ratio setting means for setting independently amplitudes of the digital tone signals of each of said groups according to selectable tone colors;

addition means for adding together digital tone signals having the set amplitudes respectively for each of said groups; and a plurality of memory means for temporarily storing results of addition for the respective groups.

4. An electronic musical instrument as defined in claim 2 wherein said mixing means comprises:

mixing ratio setting means for setting independently amplitudes of the digital tone signals of each of said groups according to said tone colors;

addition means for adding together digital tone signals having the set amplitudes respectively for each of said groups; and a plurality of memory means for temporarily storing results of addition for the respective groups.

5. An electronic musical instrument as defined in claim 1 wherein said tone generation means generates said digital tone signals in time division by employing a common hardware adapted for tone generation, said dividing means performs a dividing operation in synchronism with a time division timing of said respective tone generation means, said mixing means includes memory areas for temporarily storing said mixed signals respectively; and said multiplexing means multiplexes said mixed signals stored in said memory areas by sampling them in response to a predetermined time division timing clock.

6. An electronic musical instrument comprising:

tone generation means of a plurality of channels each being capable of independently selecting a tone color and generating a digital tone signal of a selected tone color in response to operation of a key or a switch;

distribution means for distributing digital tone signals generated by said tone generation means in specific combinations to one or more of a specific number of channels;

mixing means for mixing the digital tone signals distributed by said distribution means for respective channels;

selection means for sequentially selecting digital tone signals of the respective channels mixed by said mixing means;

data conversion means for converting the selected digital tone signals to data in a floating-point representation;

digital-to-analog conversion means for converting mantissa data in the floating-point representation derived from said data conversion means to analog signals;

voltage dividing means for voltage-dividing the analog signals provided by said digital-to-analog conversion means in response to exponent data in the floating-point representation; and sample and hold means for sampling and holding the analog tone signals provided by said voltage dividing means in synchronism with the selection in said selection means for respective channels.

7. An electronic musical instrument as defined in claim 6 wherein said data conversion means detects ineffective bits in the digital tone signals selected by said selection means, delivers out data obtained by removing these ineffective bits from the digital tone signals as the mantissa data and also delivers out data representing the number of the removed ineffective bits as the exponent data.

8. An electronic musical instrument as defined in claim 7 wherein said data conversion means comprises a table which judges the number of ineffective bits in response to a state of signals of predetermined higher bits in the selected digital tone signals and provides data representing the number of the ineffective bits and a circuit which removes ineffective higher bits in the selected digital tone signals in response to the data representing the number of the ineffective bits provided by said table.

9. An electronic musical instrument comprising:

tone generator means for generating a plurality of different digital musical tone signals in respective time division multiplex channels, a digital-to-analog converter utilized commonly on a time division multiplex basis for all of said channels, said digital-to-analog converter receiving and converting to analog form the time division multiplexed plural digital musical tone signals generated by said tone generator means, and a plurality of sample and hold circuits, each associated with a respective one of said time division multiplex channels, each respectively sampling and holding the analog output of said digital-to-analog converter in time correspondance with the associated channel, said sample and hold circuits delivering the analog signals held thereby as respective sustained analog musical tone signals.

* * * * *